US012007139B2

(12) United States Patent
Jespersen et al.

(10) Patent No.: US 12,007,139 B2
(45) Date of Patent: Jun. 11, 2024

(54) BUILDING SYSTEM COMPRISING A CEILING SYSTEM

(71) Applicant: SAINT-GOBAIN ECOPHON AB, Hyllinge (SE)

(72) Inventors: Uffe Jespersen, Sonderso (DK); Gael Tougne, Kopenhamn (DK); Mats-Arne Olsson, Jonstorp (SE)

(73) Assignee: SAINT-GOBAIN ECOPHON AB, Hyllinge (SE)

( * ) Notice: Subject to any disclaimer, the term of this patent is extended or adjusted under 35 U.S.C. 154(b) by 470 days.

(21) Appl. No.: 17/297,797

(22) PCT Filed: Nov. 28, 2019

(86) PCT No.: PCT/EP2019/082877
§ 371 (c)(1),
(2) Date: May 27, 2021

(87) PCT Pub. No.: WO2020/114876
PCT Pub. Date: Jun. 11, 2020

(65) Prior Publication Data

US 2022/0011007 A1 Jan. 13, 2022

(30) Foreign Application Priority Data

Dec. 3, 2018 (EP) ..... 18209786

(51) Int. Cl.
*E04B 9/02* (2006.01)
*E04B 2/72* (2006.01)
(Continued)

(52) U.S. Cl.
CPC ..... *F24F 13/0227* (2013.01); *E04B 2/72* (2013.01); *E04B 9/008* (2013.01); *E04B 9/02* (2013.01); *F24F 13/06* (2013.01); *E04B 9/006* (2013.01)

(58) Field of Classification Search
CPC ..... E04B 9/008; E04B 9/02; F24F 13/0227; F24F 13/06; F24F 13/0272; F24F 13/068; F24F 2221/14
See application file for complete search history.

(56) References Cited

U.S. PATENT DOCUMENTS 4,175,360 A * 11/1979 Mulvey ..... E04B 9/006 52/39
6,308,480 B1 * 10/2001 Haney ..... E04B 9/02 52/220.8
(Continued)

FOREIGN PATENT DOCUMENTS

CA 2 772 766 A1 9/2012
CN 101718129 A 6/2010
(Continued)

OTHER PUBLICATIONS

Canadian Office Action dated Feb. 13, 2023 in Canadian Patent Application No. 3,120,907, citing references 1 and 15 therein, 8 pages.
(Continued)

*Primary Examiner* — Ko-Wei Lin
(74) *Attorney, Agent, or Firm* — Oblon, McClelland, Maier & Neustadt, L.L.P.

(57) ABSTRACT

A building system includes a building space defined by a structural ceiling and a flooring of a building, and a ceiling system. The ceiling system includes an air permeable suspended ceiling arranged below the structural ceiling, and a plenum space is formed between the suspended ceiling and the structural ceiling and a flooring space is formed between the flooring and the suspended ceiling. A plurality of partition wall sections is arranged in the plenum space extending between the structural ceiling and the suspended ceiling and forms a plurality of plenum modules distributed across the plenum space. Each plenum module includes equipment.
(Continued)

The equipment of each plenum module includes a supply air device for delivery of supply air to the associated plenum module for pressurization thereof such that the supply air delivered to the plenum module is supplied to the flooring space through the air permeable suspended ceiling.

19 Claims, 4 Drawing Sheets

(51) Int. Cl.

| | |
|---|---|
| ***E04B 9/00*** | (2006.01) |
| ***F24F 13/02*** | (2006.01) |
| ***F24F 13/06*** | (2006.01) |

(56) References Cited

U.S. PATENT DOCUMENTS

| | | | | |
|---|---|---|---|---|
| 10,246,877 | B1 * | 4/2019 | Alpiger | E04B 9/02 |
| 2003/0213853 | A1 * | 11/2003 | Demster | F24F 7/08 454/239 |
| 2006/0076425 | A1 * | 4/2006 | Demster | F24F 11/88 454/239 |
| 2007/0066213 | A1 * | 3/2007 | Helgeson | F24F 13/06 454/247 |
| 2012/0071082 | A1 * | 3/2012 | Karamanos | F24F 5/0003 29/890.03 |
| 2012/0216986 | A1 * | 8/2012 | Kjellerstedt | F24F 1/0067 165/59 |
| 2012/0240495 | A1 * | 9/2012 | Eychaner | E04B 9/20 52/506.07 |
| 2014/0124165 | A1 * | 5/2014 | Moore | F24F 13/12 165/57 |
| 2014/0196488 | A1 * | 7/2014 | Roberts | E03B 3/28 62/93 |
| 2016/0178146 | A1 * | 6/2016 | Oleske | E04B 9/0421 52/28 |
| 2017/0101778 | A1 * | 4/2017 | Schreiber | E04B 9/02 |
| 2017/0108239 | A1 * | 4/2017 | Michalski | F24F 13/04 |
| 2017/0307242 | A1 * | 10/2017 | Handsaker | F24F 13/078 |
| 2018/0313558 | A1 * | 11/2018 | Byers | E04B 9/0421 |
| 2019/0186133 | A1 * | 6/2019 | Scherrer | F24F 7/04 |
| 2019/0368751 | A1 * | 12/2019 | Seki | F24F 1/0047 |

FOREIGN PATENT DOCUMENTS

| | | | |
|---|---|---|---|
| WO | WO 02/40926 | A1 | 5/2002 |
| WO | WO 2018/097795 | A1 | 5/2018 |

OTHER PUBLICATIONS

Indian Office Action dated Nov. 11, 2022 in Indian Patent Application No. 202127021176, 5 pages.

International Search Report dated Feb. 10, 2020 in PCT/EP2019/082877 filed on Nov. 28, 2019.

Canadian Office Action dated Sep. 14, 2023 in Canadian Patent Application No. 3,120,907, 7 pages.

* cited by examiner

BUILDING SYSTEM COMPRISING A CEILING SYSTEM

FIELD OF THE INVENTION

The present invention relates to a building system and more specifically to such a building system comprising a ceiling system in a building space defined by a structural ceiling and a flooring.

BACKGROUND ART

A building such as a commercial building may comprise one or more building spaces defined by a structural ceiling and a flooring of the building. A suspended ceiling may be arranged below the structural ceiling defining a flooring space between the suspended ceiling and the flooring. The flooring may be partitioned into a plurality of areas or rooms by means of partition walls.

The building space may be provided with equipment for ventilation and lighting, and the equipment is arranged to provide desired conditions in each area or room of the flooring space. The equipment is often arranged in the plenum space defined between the structural ceiling and the suspended ceiling.

The distribution of rooms or areas in the flooring space, i.e. the room layout, may be changed several times during the life time of the building, and each change of room layout often necessitates changes in the equipment for ventilation and lighting. Thus, even a little change in the room layout relating to only a minor part of the flooring space may result in a change with regard to the equipment for ventilation and lighting affecting the entire flooring space. As a consequence, a change in the room layout may be time consuming to execute and may also affect the daily operation in the entire flooring space while the refurbishing work is ongoing.

SUMMARY OF THE INVENTION

In view of that stated above, the object of the present invention is to provide a building system providing an efficient infrastructure in a building.

Another object is to provide such a building system enabling efficient room ventilation for a building space and which facilitates adaptations in an existing room layout.

To achieve at least one of the above objects, and also other objects that will be evident from the following description, a building system having the features defined in claim 1 is provided according to the present invention. Preferred embodiments of the building system will be evident from the dependent claims.

More specifically, there is provided according to the present invention a building system comprising a building space defined by a structural ceiling and a flooring of a building, and a ceiling system, the ceiling system comprising an air permeable suspended ceiling arranged below the structural ceiling, wherein a plenum space is formed between the suspended ceiling and the structural ceiling and a flooring space is formed between the flooring and the suspended ceiling, and a plurality of partition wall sections, the plurality of partition wall sections being arranged in the plenum space, extending between the structural ceiling and the suspended ceiling and forming a plurality of plenum modules distributed across the plenum space, wherein each of the plurality of plenum modules comprises equipment, the equipment of each plenum module comprising a supply air device for delivery of supply air to the associated plenum module for pressurization thereof such that the supply air delivered to the plenum module is supplied to the flooring space through the air permeable suspended ceiling.

The provision of a plurality of plenum modules comprising equipment in the form of a supply air device for each plenum module in combination with the provision of an air permeable suspended ceiling allows for controlled delivery of supply air to the part of the flooring space situated below the associated plenum module by means of diffuse ceiling ventilation. The plenum module forms a defined part of the plenum space, and the plenum module thus forms an enclosed pressure zone for the supply air. By delivery of the supply air to the plenum module, a small positive pressure is established inside the plenum module. The supply air delivered to the plenum module by means of the supply air device is then allowed to diffuse or penetrate through the air permeable suspended ceiling and enter the flooring space below over a large area, resulting in a flow of the supply air with no concentrated jet region, thereby providing high ventilation capacity while avoiding the creation of thermal discomfort such as draught even if the supply air temperature is different from the room temperature and the air flow is high. Thus, the ceiling system allows for a controlled ventilation of the flooring space providing good air quality and thermal comfort.

The diffusion or penetration of the supply air through the air permeable suspended ceiling may occur through ceiling tiles of the suspended ceiling, in which case the ceiling tiles themselves are air permeable. Alternatively, or in addition, the diffusion or penetration may occur through small gaps, slits or openings in the suspended ceiling. However, air permeability of the ceiling tiles and, when applicable, the size of the small gaps, slits or openings are configured such that pressurization of the plenum modules is enabled for a given supply rate of the supply air.

One or more plenum modules may be utilized when partitioning a room in the flooring space simply by aligning the partition walls defining the room with suitable partition wall sections of the one or more plenum modules. As described above, each plenum module forms an enclosed pressure zone for the supply air delivered to the plenum module, and thus the delivery of supply air to the room via diffuse ceiling ventilation may be uniform and controlled also in the case the room extends over two or more plenum modules.

The ceiling system facilitates changes in the room layout of the flooring space since additional partition walls may be erected at a later stage and aligned with unused partition wall sections in the plenum space such that the modular feature of the ceiling system is maintained. Correspondingly, partition walls may be removed at a later stage. A change in room layout does thus not require major changes of the ceiling system, and may thus be carried out swiftly. Also, the modular feature of the ceiling system ensures that a change in room layout only concerning a minor part of the flooring space does not affect the daily operation in the entire flooring space while the refurbishing work is ongoing.

The air permeable suspended ceiling may be configured such that the pressure drop of the supply air when supplied from each pressurized plenum module to the flooring space is in the range of 2-15 $N/m^2$. The configuration may comprise selection of a suitable air flow resistance of ceiling tiles included in the suspended ceiling and/or provision of the suspended ceiling with small slits or gaps.

According to an embodiment, the plurality of plenum modules may be distributed across the plenum space in accordance with a plenum module layout forming a modularization layout of the flooring space. Hereby, the process of designing the room layout of the flooring space is further facilitated. The modularization layout formed by the plenum module layout indicates the possible positions for erecting partition walls in the flooring space aligned with the partition wall sections in the plenum space such that the advantages of the plenum modules may be utilized. This means that the ceiling system controls the design of the room layout in the flooring space. A later change in room layout is also facilitated as long as the change is done in accordance with the modularization layout provided by the ceiling system. Thus, one bigger room extending over several plenum modules may be converted into several smaller rooms by erecting partition walls inside the bigger room aligned with previous unused partition wall sections associated with the plenum modules. Correspondingly, two or more adjacent rooms may be converted into one big room simply by removing partition walls.

According to another embodiment of the building system, the equipment of at least one plenum module may further comprise an exhaust air device for extraction of exhaust air from the flooring space. For the case when only some of the plenum modules comprise exhaust air devices, extraction of air from a room extending across one or more plenum modules not having any exhaust air device, may be accomplished by means of an exhaust air devices arranged in partition walls providing an air flow path to a room extending across one or more plenum modules comprising an exhaust air device.

According to yet another embodiment of the building system, the equipment of each plenum module may further comprise a lighting device for illumination of a part of the flooring space situated below the associated plenum module. By the provision of a lighting device for each plenum module, changes in room layout may easily be carried out without necessitating rewiring of the lighting devices. Each lighting device may comprise one or more light units and may be mounted in or suspended from the suspended ceiling.

According to yet another embodiment of the building system, each plenum module may be associated with a sensor arrangement for collecting sensor data from a part of the flooring space situated below the associated plenum module, wherein a control unit may be arranged to receive the sensor data from the sensor arrangements for control of the equipment of each plenum module. For instance, the control unit may comprise a control box arranged in each plenum module arranged to receive the sensor data from the associated sensor arrangement. The control unit may further comprise steering boxes, wherein each steering box is arranged to receive the sensor data as input data from a group of control boxes. Each steering box may comprise a CPU arranged to control the equipment of the associated plenum modules based on the received input data.

The sensor arrangement associated with each plenum module may comprise PIR-sensor, light sensor, temperature sensor, $CO_2$-sensor, gas sensor, particle sensor and/or humidity sensor. Other types of sensors for obtaining relevant sensor data are also conceivable.

The plurality of plenum modules may comprise a plenum module group having a rectangular shape, enabling the design of a room layout comprising rooms of conventional rectangular shape.

The plurality of plenum modules may comprise a plenum module group having a unitary size, enabling the design of a room layout comprising rooms having equal size.

According to yet another embodiment of the building system, each of the plurality of plenum modules may form a closed space defined by the structural ceiling, the suspended ceiling and the associated partition wall sections. As described above this facilitates pressurization and the formation of a pressure zone inside each plenum module enabling a controlled diffuse ceiling ventilation through the suspended ceiling. The partition wall sections of the plenum modules may be non-air permeable, thereby preventing air leakage from one plenum module to an adjacent plenum module.

According to yet another embodiment of the building system, at least one partition wall section of the plurality of partition wall section may have a lower edge surface abutting a rear surface of the suspended ceiling. By designing the partition wall sections such that the lower edge surface abuts the rear surface of the suspended ceiling, it is possible to provide an unbroken suspended ceiling extending over the flooring space which may facilitate installation of the suspended ceiling.

According to yet another embodiment of the building system, at least one partition wall section of the plurality of partition wall section may a lower edge surface extending beyond a front surface of the suspended ceiling. Hereby, the partition wall section provides an indication visible from the flooring space for aligning a partition wall with the partition wall section.

The partition wall section may be utilized for securing a partition wall aligned with the same. In case the lower edge surface of the partition wall sections abuts the rear surface of the suspended ceiling, the partition wall may be indirectly secured in the partition wall section via the suspended ceiling. On the other hand, in case the lower edge surface extends beyond the front surface of the suspended ceiling, the partition wall may adjoin the lower edge surface and be directly secured in the partition wall section.

The plurality of partition wall sections may be separately formed from the structural ceiling or may be integrally formed with the structural ceiling.

According to yet another embodiment of the building system, the suspended ceiling may comprise ceiling tiles made of fiber material, such as mineral wool or wood wool. Hereby, an air permeable suspended ceiling is provided where supply air delivered to the plenum modules may penetrate through the porous structure of the ceiling tiles in a controlled manner and with a controlled pressure drop, and possible also through gaps and other openings in the suspended ceiling, to the flooring space below the plenum modules.

According to yet another embodiment of the ceiling system, the suspended ceiling may comprise ceiling tiles in the form of perforated panels such as perforated gypsum boards or perforated metal panels. Hereby, an air permeable suspended ceiling is provided where supply air delivered to the plenum modules may penetrate through perforations of the ceiling tiles in a controlled manner and with a controlled pressure drop, and possible also through gaps and other openings in the suspended ceiling, to the flooring space below the plenum modules.

The building system further comprising a plurality of partition walls arranged in the flooring space extending from the flooring to the ceiling system, wherein each partition wall of the plurality of partition walls is aligned with an associated partition wall section of the plurality of partition wall sections. Hereby, a versatile building system is provided allowing for easy adaptation of the room layout in the flooring space.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DESCRIPTION OF EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
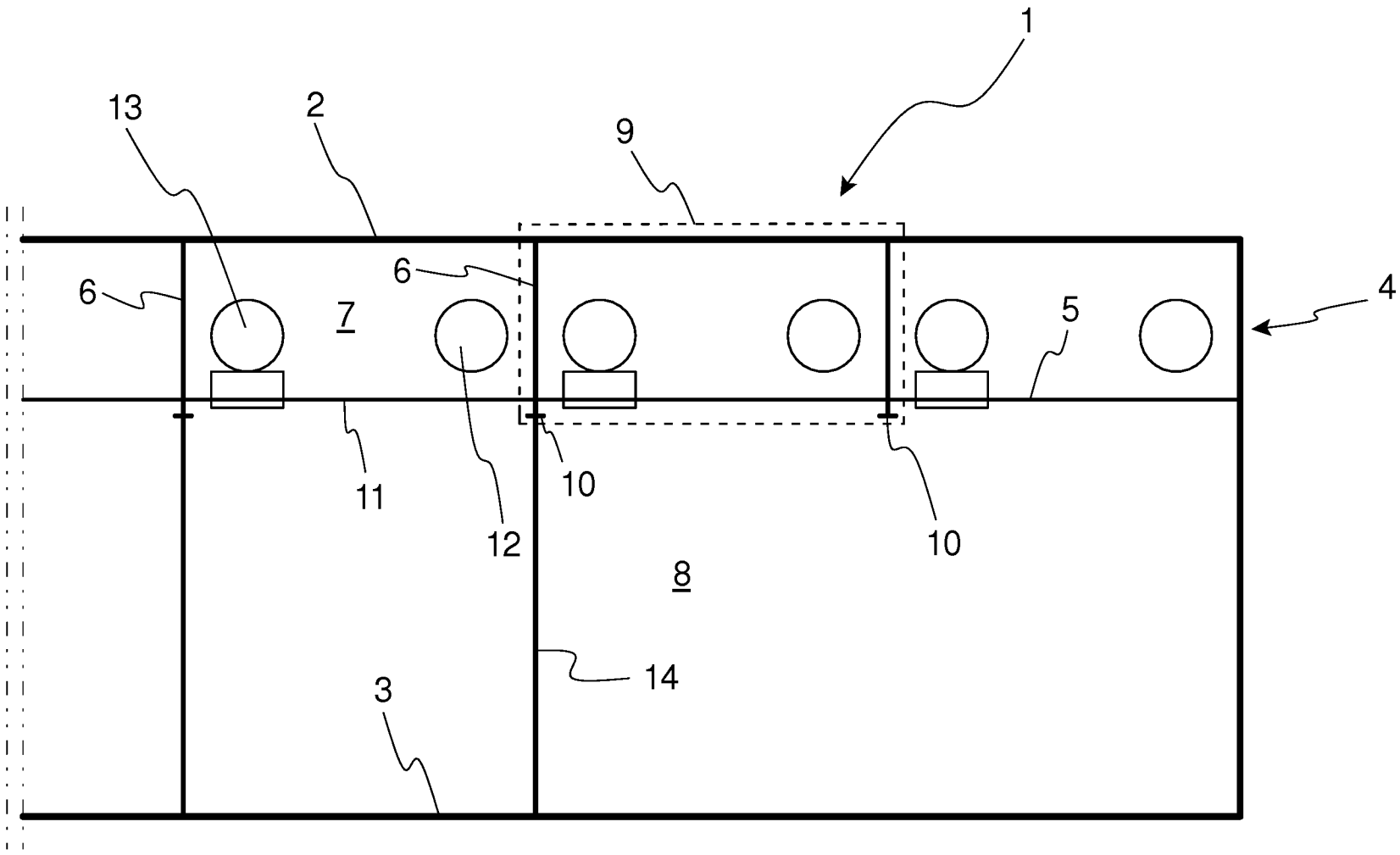
FIG. 1 is a schematic side view of a building system comprising a building space and a ceiling system.

FIG. 1 illustrates a building system 1 comprising a building space defined by a structural ceiling 2 and a flooring 3 of a building; and a ceiling system 4 arranged the in building space.

The building, such as a commercial building, may comprise one or more floors, and each floor may comprise one or more building spaces.

The ceiling system 4 comprises an air permeable suspended ceiling 5 and a plurality of partition wall sections 6.

The suspended ceiling 5 is arranged below the structural ceiling 2, wherein a plenum space 7 is formed between the suspended ceiling 5 and the structural ceiling 2 and a flooring space 8 is formed between the flooring 3 and the suspended ceiling 5.

The air permeable suspended ceiling 5 may comprise ceiling tiles made of fiber material or ceiling tiles made of perforated panel material. The fiber material may be wood wool or mineral wool, such as glass or stone wool. The fiber material may be compressed. The perforated panel material may be perforated gypsum boards or perforated metal panels.

The suspended ceiling system 4 may comprise a grid of profiles (not shown) suspended in the structural ceiling 2 and supporting the suspended ceiling 5.

The plurality of partition wall sections 6 is arranged in the plenum space 7 extend between the structural ceiling 2 and the suspended ceiling 5 such that a plurality of plenum modules 9 is formed distributed across the plenum space 7. One such plenum module 9 is indicated by dashed lines.

Each plenum module 9 forms a closed space defined by the structural ceiling 2, the suspended ceiling 5 and the associated partition wall sections 6. The plenum module 9 to the right in the figure is also defined by a wall section of the building.

The partition wall section 6 may have a lower edge surface 10 below a front surface 11 of the suspended ceiling 5, and in the shown embodiment, all partition wall sections 6 have such a lower edge surface 10 extending beyond the front surface 11 of the suspended ceiling 5.

The partition wall sections 6 may be non-air permeable.

The plurality of partition wall sections 6 may be separately formed from the structural ceiling 2, or may be integrally formed with the structural ceiling 2.

As a non-limiting example, a partition wall section 6 may comprise a frame formed by joists and studs covered by panel elements such as gypsum boards.

As another non-limiting example, a partition wall section may be formed by a fiber element having some flexibility, such as a mineral wool element, supporting a non-air permeable covering, such as aluminium foil. Such a partition wall section made of a fiber element may be wedged into place between the structural ceiling and the suspended ceiling.

Each plenum module 9 comprises equipment. More specifically, the equipment of each plenum module comprises a supply air device 12 for delivery of supply air to the associated plenum module 9.

Each supply air device 12 is arranged for delivery of supply air to the associated plenum module 9 such that the plenum module 9 is pressurized. The pressurization may correspond to establishing a small overpressure in the plenum module. The air permeability of suspended ceiling 5 then enables the supply air to be supplied to the flooring space through the suspended ceiling 5.

Since each plenum module 9 is pressurized and may form a closed space defined by the structural ceiling 2, the suspended ceiling 5 and the associated partition wall sections 6, supply air delivered to the plenum module 9 will thus in turn be delivered to the part of the flooring space 8 situated below the associated plenum module 9 in a controlled manner via the air permeable suspended ceiling 5.

The air permeable suspended ceiling 5 may be configured such that the pressure drop of the supply air when supplied from each pressurized plenum module 9 to the flooring space 8 is in the range of 2-15 $N/m^2$. Such a pressure drop may for instance be achieved by choosing a suitable air flow resistance of the ceiling tiles included in the suspended ceiling for a given supply rate of the supply air.

In the shown embodiment of the ceiling system, the equipment of each plenum module also comprises an exhaust air device 13 for extraction of exhaust air from a part of the flooring space situated below the associated plenum module 9.

The building system further comprises partition walls 14 arranged in the flooring space 8 extending from the flooring 3 to the ceiling system 4, wherein each partition wall 14 is aligned with an associated partition wall section 6 of the plurality of partition wall sections 6.

A partition wall aligned with a partition wall section may be secured in the same. When the lower edge surface of the partition wall section extends beyond the front surface of the suspended ceiling, the partition wall may adjoin the lower edge surface and be directly secured in the partition wall section.

Figure 2:
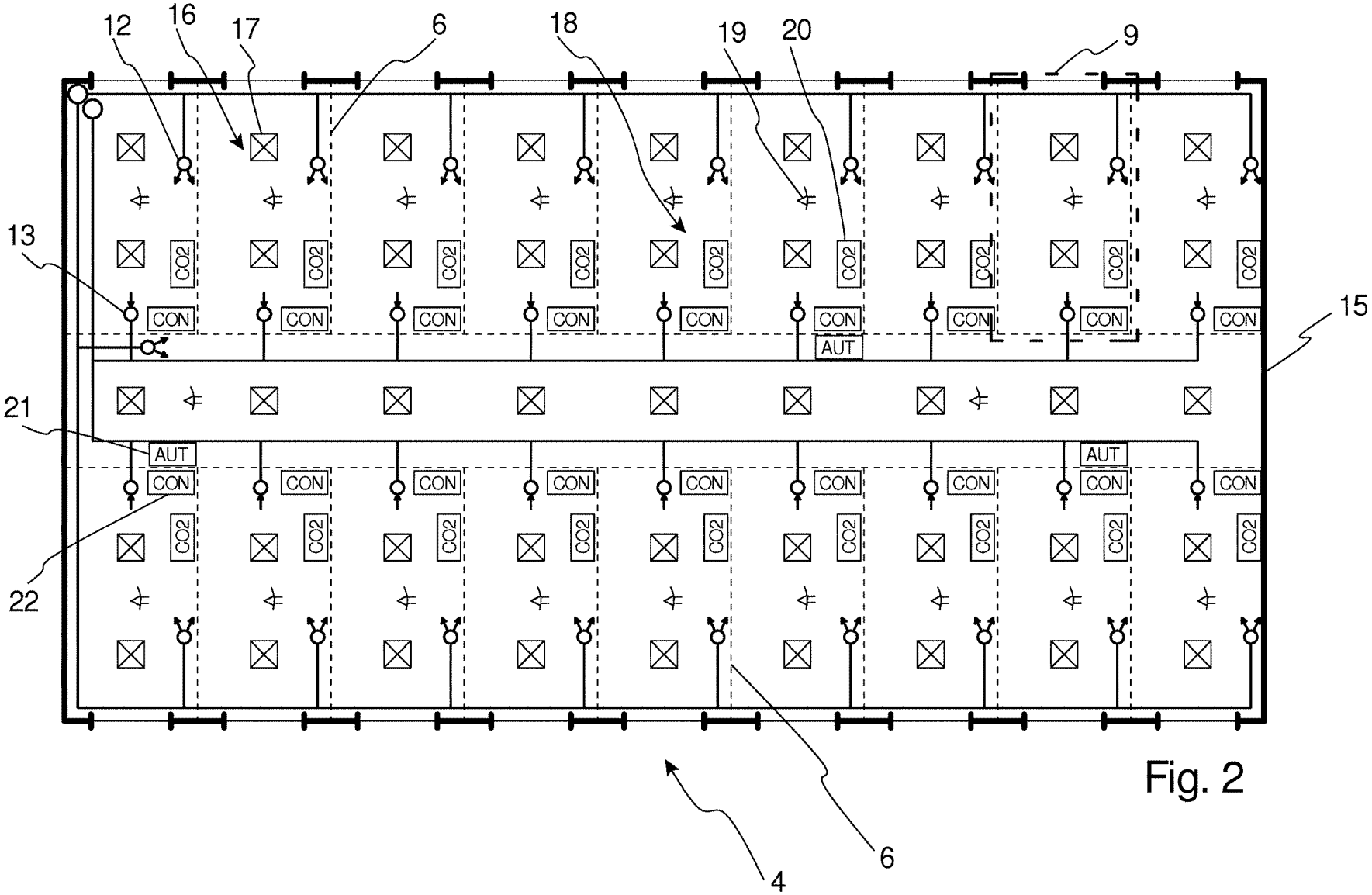
FIG. 2 is a schematic top view of a building system with a ceiling system comprising plenum modules distributed according to a plenum module layout forming a modularization layout for a flooring space.

In FIG. 2, to which reference now is also made, the ceiling system 4 arranged in a building space is illustrated from above.

The partition wall sections 6 are illustrated by dashed lines and define a plurality of plenum modules 9 distributed across the plenum space 7. More specifically, the plenum modules 9 are distributed in accordance with a plenum module layout forming a modularization layout of the flooring space 8. The plenum module layout forming the modularization layout corresponds to the extension of the partition wall sections 6 in combination with the wall sections 15 of the building. It is understood that some plenum modules also may be defined by other building elements, such as stairwells or elevator shafts, and that the plenum module layout in such cases also is affected by these building elements.

The plenum module layout may be determined by a modularization property of the building, and the in the shown embodiment the plenum module layout is based on the window layout in the facade of the building.

The plenum module layout may form a modularization layout for room modules and aisle or corridor modules situated below the associated plenum modules 9.

In the shown embodiment, a group of plenum modules 9 has a rectangular shape and a unitary size corresponding to room modules in the modularization layout of the flooring space 8.

One plenum module has an elongated rectangular shape corresponding to a corridor module of the modularization layout.

The modularization layout of the flooring space 8 thus indicates the possible positioning of partition walls 14 in the flooring space such that the partition walls 14 are aligned with partition wall sections 6 arranged in the plenum space 7. Thus, when determining the actual room layout of the flooring space 8, the modularization layout will determine the possible distribution of rooms, areas and aisles.

In the shown embodiment, each plenum module 9 comprises equipment.

The equipment comprises a supply air device 12 for delivery of supply air to the associated plenum module 9. As described above, the supply air will be delivered to the part of the flooring space 8 situated below the associated plenum module 9 via the air permeable suspended ceiling 5. The supply air devices 12 may comprise VAV (variable air volume) dampers and silencers.

The suspended ceiling 5 may comprise ceiling tiles made of compressed mineral fibre material, and in such a case, the supply air may be delivered to the flooring space 8 by penetrating or diffusing through the porous structure of the ceiling tiles. Alternatively, the suspended ceiling 5 may comprise ceiling tiles made of perforated boards, such as gypsum boards, and in such a case the supply air will be delivered to the flooring space 8 via the perforations in the ceiling tiles.

The equipment of each plenum module further comprises an exhaust air device 13 for extraction of exhaust air from a part of the flooring space 8 situated below the associated plenum module 9.

It is understood that each plenum module need not comprise an exhaust air device. For instance, when designing a room layout based on the modularization layout, some rooms may be provided with exhaust devices installed in the partition walls, and the plenum module/modules of such a room does thus not need an exhaust air device arranged in the associated plenum module/modules.

The equipment further comprises a lighting device 16 for illumination of a part of the flooring space 8 situated below the associated plenum module 9. In the shown embodiment, the lighting devices 16 of the plenum modules 9 comprised in the plenum module group having a rectangular shape and unitary size each comprises two light units 17, and the elongated rectangular plenum module 9 comprises nine light units 17.

The plenum module may further be associated with a sensor arrangement 18 for collecting sensor data from a part of the flooring space 7 situated below the associated plenum module 9. The sensor arrangement may comprise PIR-sensor, light sensor, temperature sensor, $CO_2$-sensor (20), gas sensor, particle sensor and/or humidity sensor. It is understood that the sensor arrangement may comprise other types of sensors for obtaining relevant sensor data for control of the equipment. The sensors may be arranged in a part of the suspended ceiling 5 defining the associated plenum module 9, or may be arranged in the part of the flooring space 8 situated below the associated plenum module 9.

In the shown embodiment, the plenum modules 9 of unitary size are each associated with a sensor arrangement 18 comprising PIR-sensor 19 and $CO_2$-sensor 20.

The ceiling system 4 may comprise a control unit arranged to receive the input data from the sensor arrangements 18 for control of the equipment of each plenum module 9.

In the shown embodiment, the control unit comprises three steering boxes 21 as well as a control box 22 associated with each plenum module 9 comprised in the plenum module group having a rectangular shape and unitary size.

Each steering box 21 comprises a CPU, power supply and other necessary components, and is connected to the control boxes 22 of a group of plenum modules.

Each control box 22 is coupled to the sensor arrangement 18 of the associated plenum module 9 and is arranged to receive sensor data from the sensor arrangement 18 and to transfer the sensor data as input data to the associated steering box 21.

Thus, the air supply devices 12 may be controlled by the steering boxes 24 based on input data obtained from associated control boxes 22 comprising sensor data from for instance temperature sensors, PIR-sensors and/or $CO_2$-sensors. Further, the lighting devices 16 may be controlled by the steering boxes 21 based on input data obtained from associated control boxes 22 comprising sensor data from for instance PIR-sensors.

Figure 3:
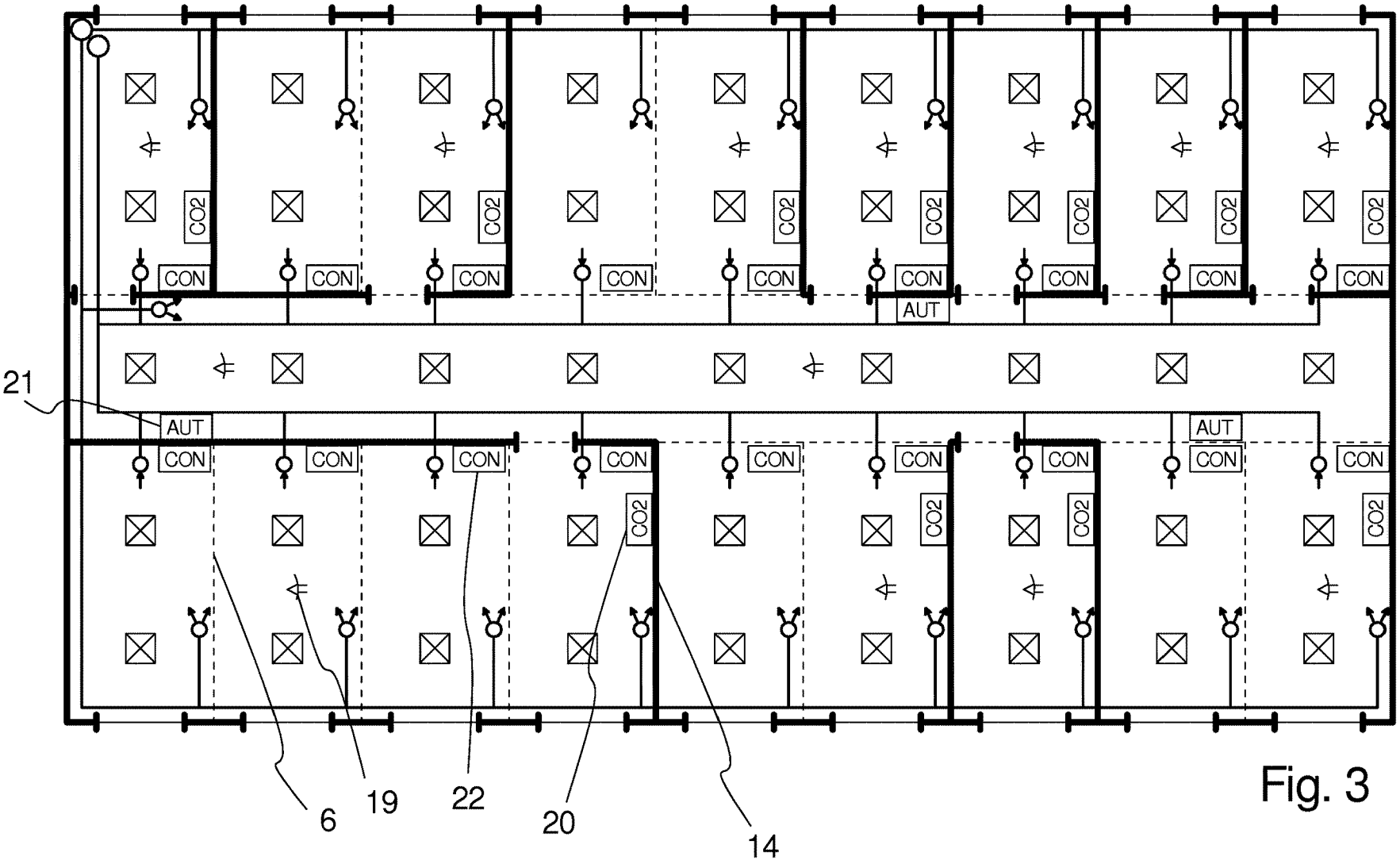
FIG. 3 is a schematic top view of a building system with a ceiling system according to FIG. 2 and partition walls.

FIG. 3 illustrates a building space comprising the ceiling system, wherein the modularization layout formed by plenum module layout has been utilized for designing the room layout of the flooring space by the provision of partition walls 14.

More specifically, a number of partition walls 14 has been installed in the flooring space and aligned with associated partition wall sections 6 for delimiting rooms, areas and a corridor. The partition wall sections 6 are indicated by dashed lines, and the installed partition walls 14 is, as indicated in the figure, aligned with and thus overlaying a selected number of the partition wall sections 6.

The sensor arrangements 18 have been adjusted in accordance with room layout.

For instance, in the shown embodiment, a first room located in the lower left hand corner of the building space extends over four consecutive plenum modules 9. The sensor arrangements 18 of the plenum modules 9 have accordingly been adjusted in accordance with the size of the first room, and more specifically, three PIR-sensors and three $CO_2$-sensors have been disconnected from the associated connections boxes 22 such that only one PIR-sensor 19 and one $CO_2$-sensor 20 remain active for obtaining sensor data from the first room. Corresponding amendments have been made for the remaining rooms and areas.

The overall sensor arrangement set up is implemented in the steering boxes 21 coupled to the associated connection boxes 22 for controlling the equipment.

The ceiling system facilitates modifications in the room layout at a later stage. For instance, if were to be decided that the relatively large first room should be converted into two rooms, this may easily be accomplished by erecting an additional partition wall in the first room in accordance with the modularization layout and by adjusting the sensor arrangements such that a $CO_2$-sensor and a PIR-sensor are provided for each room, and also by implementing the new sensor arrangement set up in the steering box coupled to the associated connection boxes.

It will be appreciated that the present invention is not limited to the embodiments shown.

For instance, in the shown embodiments, the partition wall sections 6 have been disclosed as having such an extension that the lower edge surface 10 of each partition wall section 6 extends beyond the front surface 11 of the suspended ceiling 5. Such a design provides a clear indication of the modularization layout which is visible from the flooring space 8 and which makes it easy to align partition walls 14 with the associated partition wall sections 6.

Figure 4:
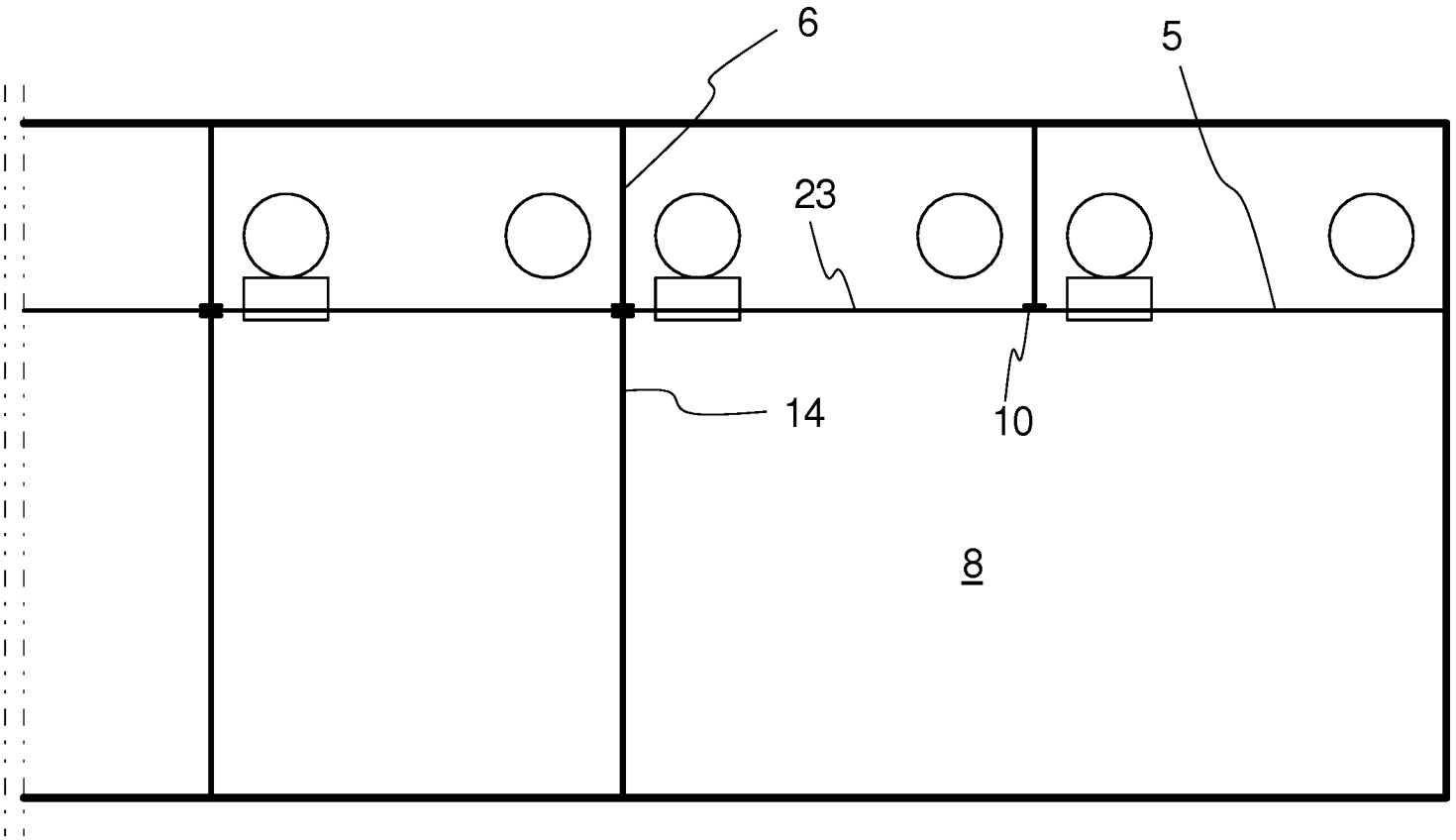
FIG. 4 is a schematic side view comprising an alternative embodiment of the building system.

However, it is also feasible to arrange the partition wall sections 6 with lower edge surfaces 10 abutting a rear surface 23 of the suspended ceiling 5, as illustrated in FIG. 4. Such a configuration may make it a bit more difficult to align the partition walls 14 with the associated partition wall sections 6, but on the other the configuration allows for provision of an unbroken suspended ceiling 5 which may be more easy to install. The partition wall 14 may be indirectly secured in the associated partition wall section 6 via the suspended ceiling 5.

Several modifications and variations are thus conceivable within the scope of the invention which thus is exclusively defined by the appended claims.

The invention claimed is:

1. A building system comprising:

a building space defined by a structural ceiling and a flooring of a building, and a ceiling system, the ceiling system comprising an air permeable suspended ceiling arranged below the structural ceiling, wherein a plenum space is formed between the suspended ceiling and the structural ceiling and a flooring space is formed between the flooring and the suspended ceiling, and a plurality of partition wall sections, the plurality of partition wall sections being arranged in the plenum space, extending between the structural ceiling and the suspended ceiling and forming a plurality of plenum modules distributed across the plenum space, wherein each of the plurality of plenum modules comprises equipment, the equipment of each plenum module comprising a supply air device to deliver supply air to the associated plenum module for pressurization thereof such that the supply air delivered to the associated plenum module is supplied to the flooring space through the air permeable suspended ceiling, and wherein at least one partition wall section of the plurality of partition wall sections has a lower edge surface abutting a upper surface of the suspended ceiling.

2. The building system according to claim 1, wherein the air permeable suspended ceiling is configured such that the pressure drop of the supply air when supplied from each pressurized plenum module to the flooring space is in a range of 2-15 $N/m^2$.

3. The building system according to claim 1, in which the plurality of plenum modules is distributed across the plenum space in accordance with a plenum module layout forming a modularization layout of the flooring space.

4. The building system according to claim 1, in which the equipment of at least one plenum module of the plurality of plenum modules further comprises an exhaust air device for extraction of exhaust air from the flooring space.

5. The building system according to claim 1, in which the equipment of each plenum module further comprises a lighting device to illuminate a part of the flooring space situated below the associated plenum module.

6. The building system according to claim 1, in which each plenum module is associated with a sensor arrangement to collect sensor data from a part of the flooring space situated below the associated plenum module, wherein a control unit is arranged to receive the sensor data from the sensor arrangements to control the equipment of each plenum module.

7. The building system according to claim 6, wherein the sensor arrangement comprises a PIR-sensor, a light sensor, a temperature sensor, a CO2-sensor, a gas sensor, a particle sensor, or a humidity sensor.

8. The building system according to claim 1, in which the plurality of plenum modules comprises a plenum module group having a rectangular shape.

9. The building system according to claim 1, in which the plurality of plenum modules comprises a plenum module group having a unitary size.

10. The building system according to claim 1, in which each of the plurality of plenum modules forms a space defined by the structural ceiling, the suspended ceiling, and the associated partition wall sections.

11. A building system comprising:

a building space defined by a structural ceiling and a flooring of a building, and a ceiling system, the ceiling system comprising an air permeable suspended ceiling arranged below the structural ceiling, wherein a plenum space is formed between the suspended ceiling and the structural ceiling and a flooring space is formed between the flooring and the suspended ceiling, and a plurality of partition wall sections, the plurality of partition wall sections being arranged in the plenum space, extending between the structural ceiling and the suspended ceiling and forming a plurality of plenum modules distributed across the plenum space, wherein each of the plurality of plenum modules comprises equipment, the equipment of each plenum module comprising a supply air device to deliver supply air to the associated plenum module for pressurization thereof such that the supply air delivered to the associated plenum module is supplied to the flooring space through the air permeable suspended ceiling, and wherein at least one partition wall section of the plurality of partition wall sections has a lower edge surface extending beyond a lower surface of the suspended ceiling.

12. The building system according to claim 1, wherein the plurality of partition wall sections is non-air permeable.

13. The building system according to claim 1, wherein the plurality of partition wall sections is separately formed from the structural ceiling.

14. The building system according to claim 1, wherein the plurality of partition wall sections is integrally formed with the structural ceiling.

15. The building system according to claim 1, wherein the suspended ceiling comprises ceiling tiles made of mineral fiber material.

16. The building system according to claim 1, wherein the suspended ceiling comprises ceiling tiles made of mineral wool or wood wool.

17. The building system according to claim 1, wherein the suspended ceiling comprises ceiling tiles in the form of perforated panels.

18. The building system according to claim 1, wherein the suspended ceiling comprises ceiling tiles in the form of perforated gypsum boards or perforated metal panels.

19. A building system comprising:

a building space defined by a structural ceiling and a flooring of a building, a ceiling system, the ceiling system comprising an air permeable suspended ceiling arranged below the structural ceiling, wherein a plenum space is formed between the suspended ceiling and the structural ceiling and a flooring space is formed between the flooring and the suspended ceiling, and a plurality of partition wall sections, the plurality of partition wall sections being arranged in the plenum space, extending between the structural ceiling and the suspended ceiling and forming a plurality of plenum modules distributed across the plenum space, further comprising a plurality of partition walls arranged in the flooring space extending from the flooring to the suspended ceiling, wherein each partition wall of the plurality of partition walls is aligned with an associated partition wall section of the plurality of partition wall sections, wherein each of the plurality of plenum modules comprises equipment, the equipment of each plenum module comprising a supply air device to deliver supply air to the associated plenum module for pressurization thereof such that the supply air delivered to the associated plenum module is supplied to the flooring space through the air permeable suspended ceiling.

* * * * *